US012060195B2

(12) United States Patent
Drechsler

(10) Patent No.: US 12,060,195 B2
(45) Date of Patent: Aug. 13, 2024

(54) CONTAINERS

(71) Applicant: Instant Brands Holdings Inc., Downers Grove, IL (US)

(72) Inventor: Alfonse Drechsler, Downers Grove, IL (US)

(73) Assignee: INSTANT BRANDS HOLDINGS INC., Downers Grove, IL (US)

( * ) Notice: Subject to any disclaimer, the term of this patent is extended or adjusted under 35 U.S.C. 154(b) by 94 days.

(21) Appl. No.: 17/853,508

(22) Filed: Jun. 29, 2022

(65) Prior Publication Data

US 2023/0002113 A1 Jan. 5, 2023

Related U.S. Application Data

(60) Provisional application No. 63/217,548, filed on Jul. 1, 2021.

(51) Int. Cl.
*B65D 21/08* (2006.01)
*B65D 43/16* (2006.01)

(52) U.S. Cl.
CPC ..... *B65D 21/08* (2013.01); *B65D 43/164* (2013.01); *B65D 2543/00685* (2013.01)

(58) Field of Classification Search
CPC ..... B65D 21/08; B65D 43/164; B65D 2543/00685; B65D 2543/00435; B65D 2543/00518; B65D 2543/00546; B65D 2543/00972; B65D 51/1666
See application file for complete search history.

(56) References Cited

U.S. PATENT DOCUMENTS

| | | | |
|---|---|---|---|
| 4,338,826 | A | 7/1982 | Jacoby et al. |
| 5,643,625 | A | 7/1997 | Perry et al. |
| 5,913,448 | A | 6/1999 | Mann et al. |
| 7,921,769 | B2 | 4/2011 | So et al. |

(Continued)

FOREIGN PATENT DOCUMENTS

| | | | |
|---|---|---|---|
| CN | 200963546 | Y | 10/2007 |
| CN | 200992324 | Y | 12/2007 |

(Continued)

OTHER PUBLICATIONS

International Search Report and Written Opinion for International Application No. PCT/US22/35671 dated Sep. 26, 2022, 15 pages.

*Primary Examiner* — Shawn M Braden
(74) *Attorney, Agent, or Firm* — Crowell & Moring LLP

(57) ABSTRACT

A container includes a lid base and a compressible portion. The lid base has a channel and configured to receive a lid. The compressible portion is connected to the lid base. The compressible portion includes a one-way valve in air communication with the channel. Another container includes a compressible portion and a container base. The compressible portion includes a bellow body, which includes at least two convolutions, each including a first living hinge and a first sidewall, at least one second living hinge positioned between the at least two convolutions and connected to the first sidewalls, and a movable bump structure positioned between the at least two convolutions to space the first living hinges apart and being movable between an outer position and an inner position relative to a container interior.

19 Claims, 17 Drawing Sheets

(56) References Cited

U.S. PATENT DOCUMENTS

| | | | |
|---|---|---|---|
| 8,313,000 | B1 | 11/2012 | Tuan |
| 8,485,388 | B2 | 7/2013 | Tuan |
| 8,844,764 | B2 | 9/2014 | Curtin et al. |
| 8,887,942 | B2 | 11/2014 | Miksovsky et al. |
| 9,016,491 | B2 | 4/2015 | Blum et al. |
| 9,079,685 | B2 | 7/2015 | Sudakoff |
| 9,119,507 | B2 | 9/2015 | Abrams et al. |
| 9,221,582 | B2 | 12/2015 | Wheeler et al. |
| 9,396,508 | B2 * | 7/2016 | Otero ..... G06T 9/00 |
| 9,492,033 | B2 | 11/2016 | Abrams et al. |
| 9,622,611 | B2 | 4/2017 | Tuan |
| 9,723,942 | B2 | 8/2017 | Do |
| 9,730,555 | B1 | 8/2017 | Lee et al. |
| 9,926,105 | B2 | 3/2018 | Tsui |
| 9,969,521 | B2 | 5/2018 | Shen |
| 10,408,522 | B2 | 9/2019 | Tsui |
| 10,674,848 | B2 | 6/2020 | Feeley et al. |
| 11,026,527 | B2 | 6/2021 | Tsui |
| 2008/0093368 | A1 * | 4/2008 | Muzik ..... B65D 1/0292 220/666 |
| 2008/0099476 | A1 | 5/2008 | Fung |
| 2009/0183565 | A1 | 7/2009 | Shamoon et al. |
| 2010/0314284 | A1 | 12/2010 | Truesdale |
| 2012/0205371 | A1 | 8/2012 | Lee |
| 2012/0217238 | A1 | 8/2012 | Chang |
| 2013/0264340 | A1 | 10/2013 | Zens |
| 2013/0284753 | A1 | 10/2013 | Kellmann |
| 2015/0034661 | A1 | 2/2015 | Cooper et al. |
| 2015/0201779 | A1 | 7/2015 | Tittel |
| 2015/0251795 | A1 | 9/2015 | Tsui |
| 2016/0059990 | A1 | 3/2016 | Patikas-Bryant |
| 2017/0008670 | A1 | 1/2017 | Wu et al. |
| 2018/0118410 | A1 * | 5/2018 | Wood ..... B65D 45/22 |
| 2018/0194517 | A1 | 7/2018 | Brooks |
| 2018/0215513 | A1 | 8/2018 | Perek |
| 2019/0075973 | A1 | 3/2019 | Charleson et al. |
| 2019/0119000 | A1 | 4/2019 | Tsui |
| 2019/0368799 | A1 | 12/2019 | Tsui |
| 2020/0231324 | A1 | 7/2020 | Swarts et al. |
| 2020/0277105 | A1 | 9/2020 | Longo |
| 2020/0305584 | A1 | 10/2020 | Tuan |
| 2021/0237933 | A1 | 8/2021 | Swarts et al. |

FOREIGN PATENT DOCUMENTS

| | | | |
|---|---|---|---|
| CN | 201235967 | Y | 5/2009 |
| CN | 201481821 | U | 5/2010 |
| CN | 201756219 | U | 3/2011 |
| CN | 201996156 | U | 10/2011 |
| CN | 202341586 | U | 7/2012 |
| CN | 202358415 | U | 8/2012 |
| CN | 202358423 | U | 8/2012 |
| CN | 202457003 | U | 10/2012 |
| CN | 202557926 | U | 11/2012 |
| CN | 202567550 | U | 12/2012 |
| CN | 202709217 | U | 1/2013 |
| CN | 203158431 | U | 8/2013 |
| CN | 206079966 | U | 4/2014 |
| CN | 203646953 | U | 6/2014 |
| CN | 204015486 | U | 12/2014 |
| CN | 204191806 | U | 3/2015 |
| CN | 204197535 | U | 3/2015 |
| CN | 204368607 | U | 6/2015 |
| CN | 204394054 | U | 6/2015 |
| CN | 204764780 | U | 11/2015 |
| CN | 204764789 | U | 11/2015 |
| CN | 204970669 | U | 1/2016 |
| CN | 105584708 | A | 5/2016 |
| CN | 105661859 | A | 6/2016 |
| CN | 205667497 | U | 11/2016 |
| CN | 205686774 | U | 11/2016 |
| CN | 205884997 | U | 1/2017 |
| CN | 206062922 | U | 4/2017 |
| CN | 206243692 | U | 6/2017 |
| CN | 206561813 | U | 10/2017 |
| CN | 206606462 | U | 11/2017 |
| CN | 107472635 | A | 12/2017 |
| CN | 206749663 | U | 12/2017 |
| CN | 206923866 | U | 1/2018 |
| CN | 207089913 | U | 3/2018 |
| CN | 207157771 | U | 3/2018 |
| CN | 207253499 | U | 4/2018 |
| CN | 207477319 | U | 6/2018 |
| CN | 207698223 | U | 8/2018 |
| CN | 207721411 | U | 8/2018 |
| CN | 207784602 | U | 8/2018 |
| CN | 108568004 | A | 9/2018 |
| CN | 207803967 | U | 9/2018 |
| CN | 207979464 | U | 10/2018 |
| CN | 208274341 | U | 12/2018 |
| CN | 109171384 | A | 1/2019 |
| CN | 208491592 | U | 2/2019 |
| CN | 208837517 | U | 5/2019 |
| CN | 208909669 | U | 5/2019 |
| CN | 208909781 | U | 5/2019 |
| CN | 209074020 | U | 7/2019 |
| CN | 209152976 | U | 7/2019 |
| CN | 209152977 | U | 7/2019 |
| CN | 209290950 | U | 8/2019 |
| CN | 209601321 | U | 11/2019 |
| CN | 209628950 | U | 11/2019 |
| CN | 209629322 | U | 11/2019 |
| CN | 209694787 | U | 11/2019 |
| CN | 110522149 | A | 12/2019 |
| CN | 110613615 | A | 12/2019 |
| CN | 209769933 | U | 12/2019 |
| CN | 209826151 | U | 12/2019 |
| CN | 209826154 | U | 12/2019 |
| CN | 209826161 | U | 12/2019 |
| CN | 110638654 | A | 1/2020 |
| CN | 209883708 | U | 1/2020 |
| CN | 209965566 | U | 1/2020 |
| CN | 209983942 | U | 1/2020 |
| CN | 210185316 | U | 3/2020 |
| CN | 210204319 | U | 3/2020 |
| CN | 210338700 | U | 4/2020 |
| CN | 210471953 | U | 5/2020 |
| CN | 210493691 | U | 5/2020 |
| CN | 210539606 | U | 5/2020 |
| CN | 111297146 | A | 6/2020 |
| CN | 210642901 | U | 6/2020 |
| CN | 210672945 | U | 6/2020 |
| CN | 210762226 | U | 6/2020 |
| CN | 210783325 | U | 6/2020 |
| CN | 210810370 | U | 6/2020 |
| CN | 210913566 | U | 7/2020 |
| CN | 210988757 | U | 7/2020 |
| CN | 210989514 | U | 7/2020 |
| CN | 211227783 | U | 8/2020 |
| CN | 211269072 | U | 8/2020 |
| CN | 211301425 | U | 8/2020 |
| CN | 211340130 | U | 8/2020 |
| CN | 211582524 | U | 9/2020 |
| CN | 111732140 | A | 10/2020 |
| CN | 211724056 | U | 10/2020 |
| CN | 211862065 | U | 11/2020 |
| CN | 211933823 | U | 11/2020 |
| CN | 211934935 | U | 11/2020 |
| CN | 212038304 | U | 12/2020 |
| CN | 212066390 | U | 12/2020 |
| CN | 212139718 | U | 12/2020 |
| CN | 212307476 | U | 1/2021 |
| CN | 212328738 | U | 1/2021 |
| CN | 212489443 | U | 2/2021 |
| CN | 212501560 | U | 2/2021 |
| CN | 212532339 | U | 2/2021 |
| CN | 212815702 | U | 3/2021 |
| CN | 212972671 | U | 4/2021 |
| CN | 213883293 | U | 8/2021 |
| EP | 3443874 | A1 | 2/2019 |
| GB | 2333085 | A | 7/1999 |

* cited by examiner

CONTAINERS

RELATED APPLICATION

This Application claims priority to U.S. Provisional Patent Application No. 63/217,548, filed on Jul. 1, 2021, which is herein incorporated by reference in its entirety.

TECHNICAL FIELD

This disclosure relates to containers, and particularly containers' structure, material, and manufacturing.

BACKGROUND

Many current containers on the market are not compressible, and therefore, a user cannot adjust their capacity according to the user's demands. Further, even if a container is compressible, a user may have difficulty to compress the container when the container is sealed and has no way to discharge the air contained inside.

BRIEF DESCRIPTION OF THE DRAWINGS

The embodiments can be better understood with reference to the following drawings and description. The components in the figures are not necessarily to scale, emphasis instead being placed upon illustrating the principles of the disclosure. Moreover, in the figures, like referenced numerals designate corresponding parts throughout the different views.

DETAILED DESCRIPTION

Figure 1A:
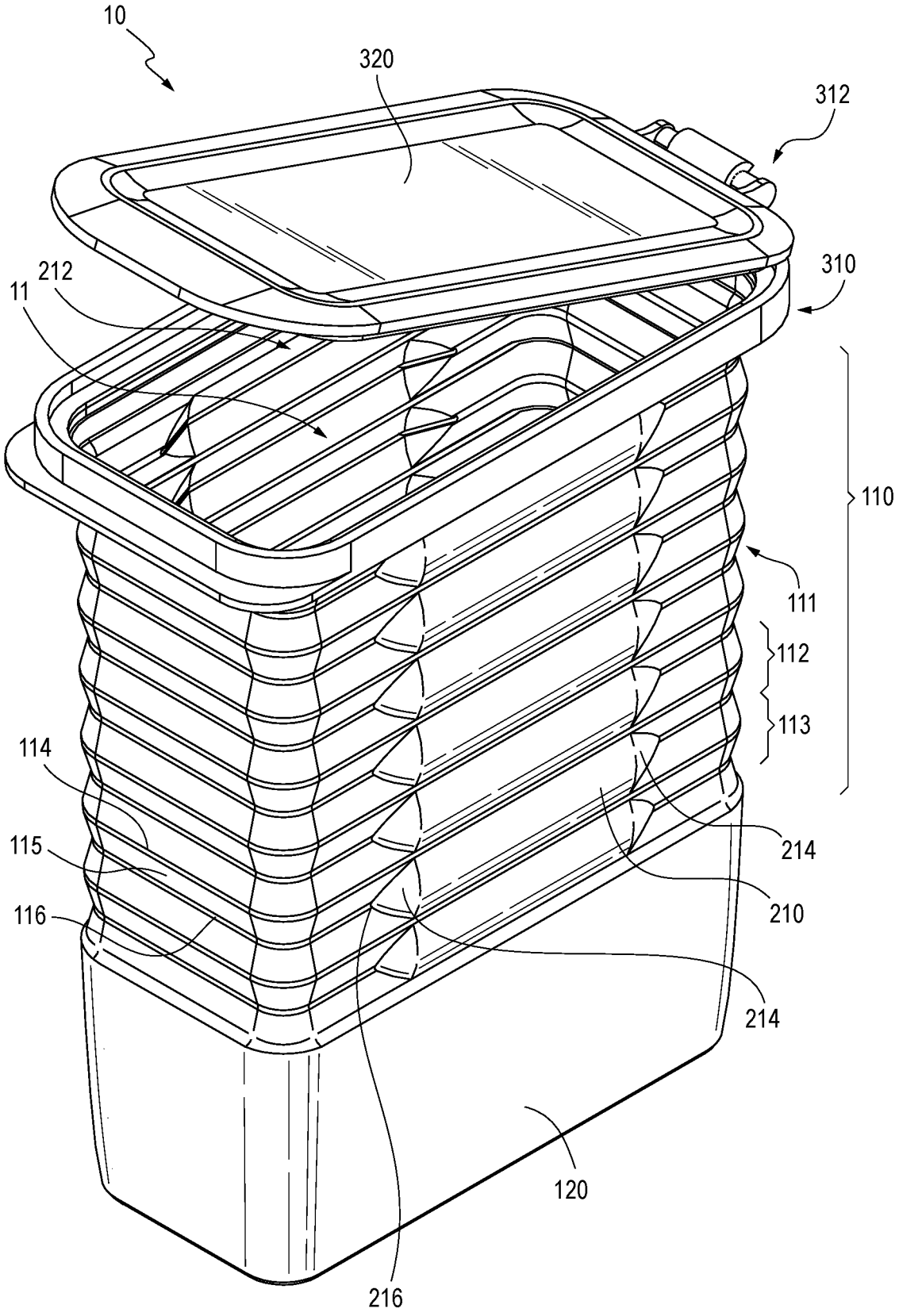
FIG. 1A is an illustration of a container according to one embodiment of this disclosure.
Figure 1B:
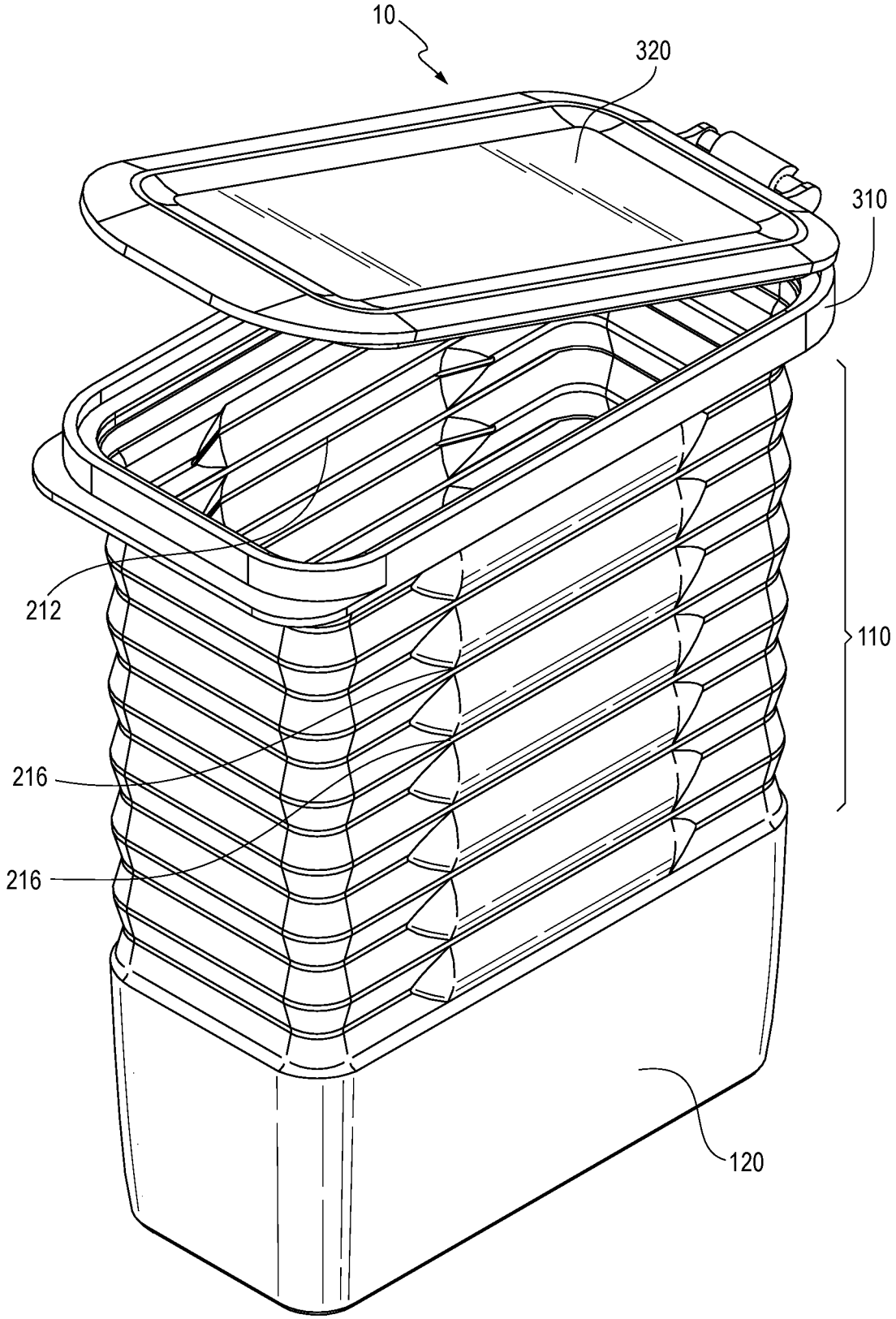
FIG. 1B is an illustration of components of the container of FIG. 1A.
Figure 1C:
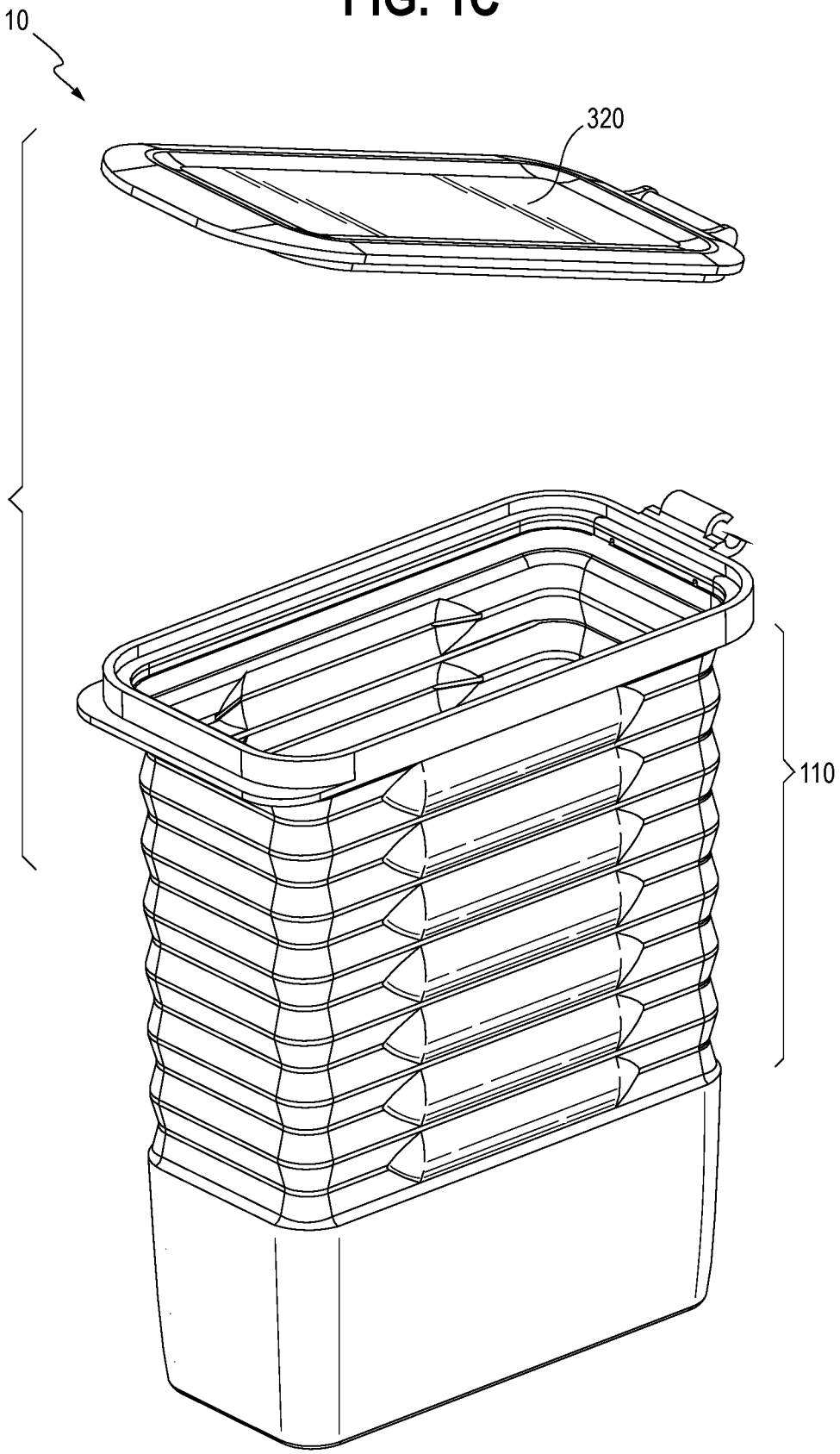
FIG. 1C is an exploded view of the components of the container of FIG. 1A.
Figure 1D:
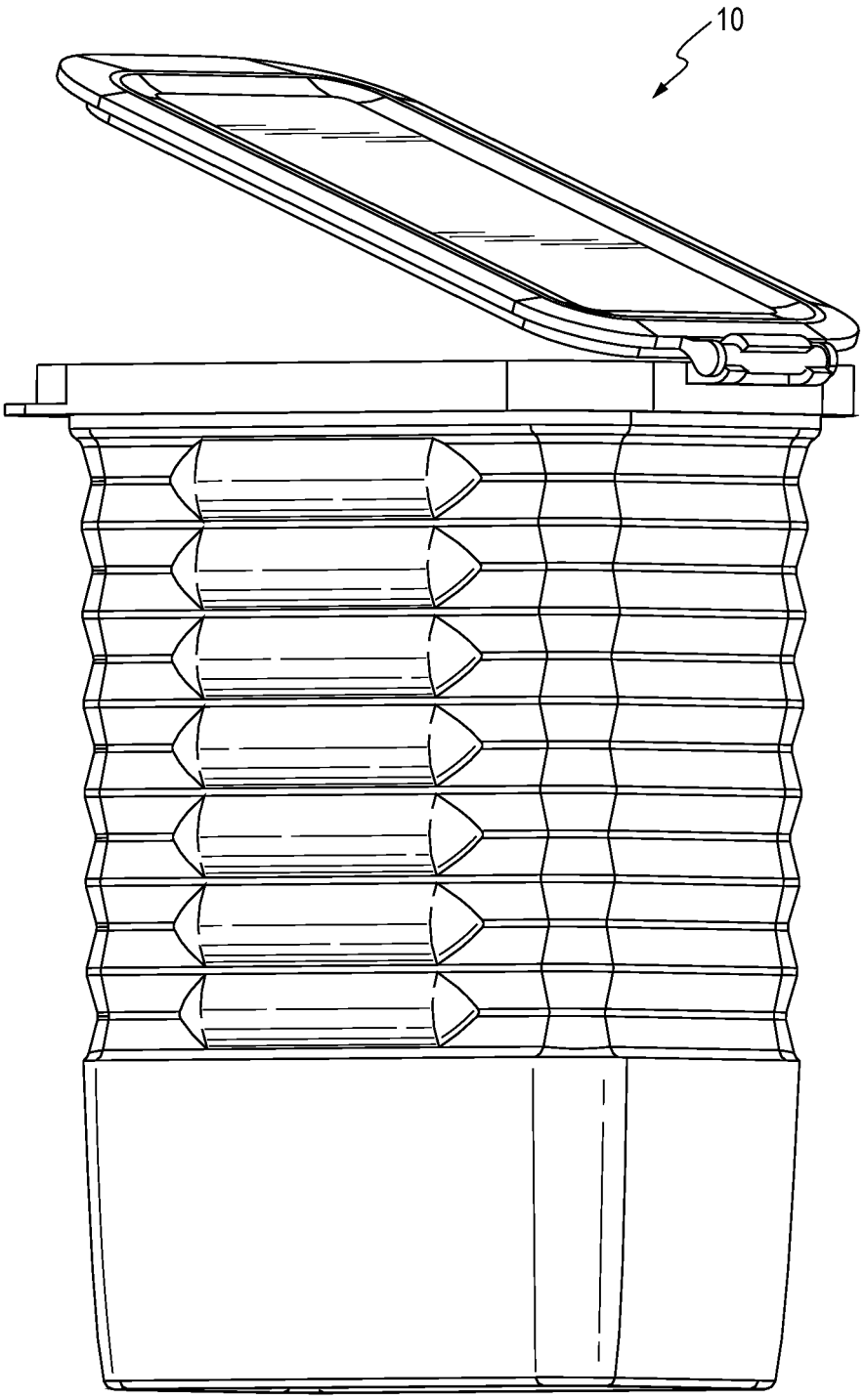
FIG. 1D is a perspective view of the container of FIG. 1A.

FIGS. 1A to 1I shows the different views of the container 10 of an embodiment of this disclosure. The container 10 includes a compressible portion 110 and a container base 120. The compressible portion 110 is connected to the container base 120. The height of the compressible portion 110 is adjustable according to the need of a user. The container base 120 may be made by a different material that is not compressible or not substantially compressible. The compressible portion 110 includes a bellow body 111, and the bellow body 111 includes at least two convolutions 112, 113. Each convolution has a first living hinge 114 (such as a crest of the convolution) and a sidewall 115. A second living hinge 116 (such as a root of two convolutions) is positioned between the two convolutions 112, 113. The second living hinge 116 is defined at the intersection of the convolutions 112, 113. The container 10 may have multiple convolutions, such as seven, or less or more, convolutions. Exemplarily, the top and the bottom of the compressible portion 110 each has a half of a convolution, and there are six convolutions between the top and bottom half convolutions. Further, the compressible portion 110 and the container base 120 can be made of silicone. The container base 120 can also be made of polypropylene or other material that has a rigidity higher than silicone.

Figure 4A:
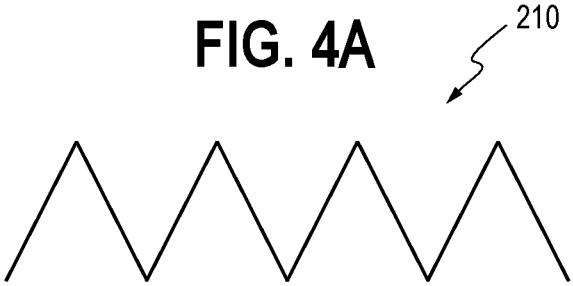
FIGS. 4A and 4B are illustrative cross-sectional view of alternative bump structure designs.
Figure 4B:
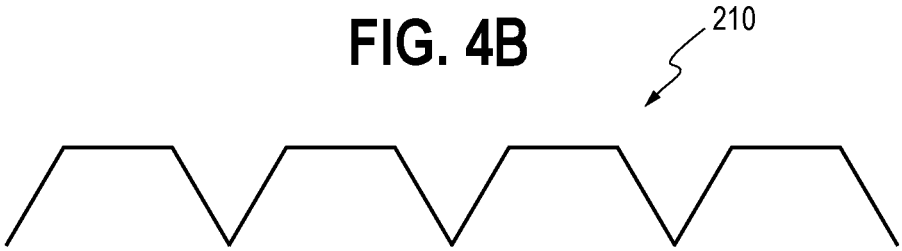

The bellow body 111 further includes at least one moveable bump structure 210. The bump structure 210 is positioned between the two convolutions 112, 113 to space two first living hinges 114 apart. In this embodiment, the container 10 includes seven moveable bump structures 210 as an example. The bump structure 210 is movable between an outer position (as shown in FIG. 1) and an inner position (when a user has pushed the bump structure inwards, as shown in FIG. 1G) relative to a container interior 11. The bellow body 111 may include multiple duplicated layers. For example, the bellow body 111 may have multiple bump structures 210, which are positioned between two convolutions of the bellow body 111. As shown in FIG. 1A as an example, there are seven bump structures in the compressible portion 110. It should be noted that the bump structure 210 is not necessarily a rounded structure. It can be a raised structure with any shape, such as, for example, a rectangular bump, a triangle bump, or a tent-shaped bump. FIGS. 4A and 4B are illustrative cross-sectional views of the bump structure 210.

Additionally, the bump structures 210 are provided at two opposite sides of the compressible portion 110. In other implementations, the bump structures 210 can be provided on one side, two adjacent sides, three sides, or even all sides of the compressible portion 110. The length or size of the bump structures 210 at the different sides of the compressible portion 110 can be different. For example, the bump structures 210 on a shorter side of the compressible portion 110 may be shorter than bump structures 210 on a longer side of the compressible portion 110, or vice versa. Further, the bump structures 210 can be provided between every convolution (as shown in the FIG. 1A) or every two, three, or more convolutions. The bump structures 210 can distribute unevenly within one side of the compressible portion 110, and the bump structures 210 can have different distributions among different sides of the compressible portion 110.

Specifically, when the bump structure 210 is the an outer position as shown in FIG. 1, the bump structure 210 provides support to the adjacent convolutions and helps the container 10 to maintain the height of the compressible portion 110. When a user wants to compress the compressible portion 110 to reduce the overall height of the container 10, the user can push a certain amount of bump structures 210 inwards toward the container interior 11. Once a bump structure 210 is pressed inwards, the adjacent convolutions can be folded or compressed more easily. For example, a user can push all the seven bump structures inwards and to fully compress the compressible portion 110. Likewise, a user can choose to push only two, three, or five bump structures 210 inwards to reduce the height of the compressible portion 110 by a smaller amount. FIGS. 1F and 1G show the front views of the container 10. In FIG. 1G some bump structures 210 are indented and some are not. It should be noted that, in this embodiment, the bump structure 210 can be situated in two stable positions, the inner position or the outer position, based on the rigidity of the material of the bump structures 210, such as silicone.

Further, when the bump structure 210 is pushed inwards toward the container interior 11, the side wall (which may be connected to two adjacent first living hinges 114) of the movable bump structure 210 can be coplanar or roughly coplanar with the sidewalls 115 of the convolutions 112 and 113 as shown in FIG. 1G. On the other hand, the surface of the movable bump structure 210 can have an offset with the surface of the sidewalls 115 of the convolutions 112 and 113 when the movable bump structure 210 is indented.

Likewise, a user can push the indented bump structures 210 outwards to use the bump structures 210 to maintain the rigidity of the compressible portion 110. In an implementation, when a user expand the compressible portion 110, the bump structures 210 may pop out automatically due to the tension of the material of the compressible portion 110.

As shown in FIG. 1A, the movable bump structure may include a third living hinge 212 (such as, but not limited to, a fold, a cease, a channel, and/or a cutout) on an inner surface of the bump structure 210, and the third living hinge 212 allows the movable bump structure 210 to be indented along with the third living hinge 212. Exemplarily, the third living hinge 212 aligns with the at least one second living hinge 116 of the bellow body 111. The third living hinge 212 may extend from one end of the sidewall of the bump structure 210 to the other end of the bump structure 210. The third living hinge 212 may, exemplarily, be situated in the middle of the inner surface of the bump structure 210 and may divide the sidewall of the bump structure 210 into an upper sidewall and a lower sidewall. The upper sidewall and the lower sidewall can pivot on the third living hinge 212 when a user pushes the bump structure 210. Further, the movable bump structure 210 includes two end walls 214 at two opposite ends of the sidewall of the bump structure 210. The two end walls are connected to the sidewalls 115 of the two convolutions 112, 113 and the second living hinge 116. Each of the two end walls 214 defines three tips 216, the three tips 216 is respectively connected to the first living hinges 114 and the second living hinge 116. In one implementation, the sidewall of the bump structure 210 has a higher rigidity that the sidewall 115 of the compressible portion 110. Further in one implementation, the sidewall of the bump structure 210 is thicker than the sidewalls 115 of the convolutions 112, 113. Further in one implementation, the sidewall of the bump structure 210 is thinner than the sidewalls 115 of the convolutions 112, 113.

Figure 1E:
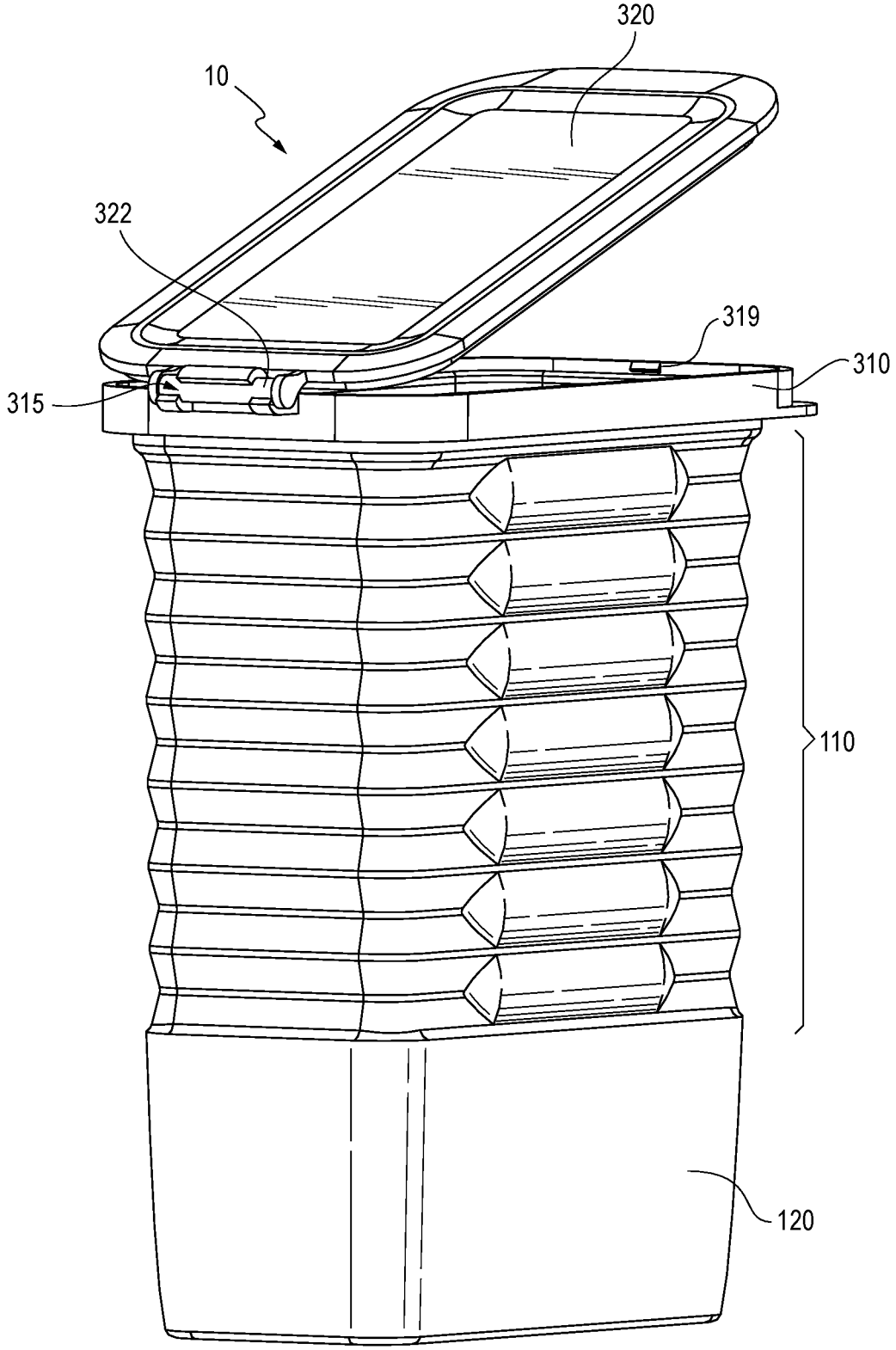
FIG. 1E is another perspective view of the container of FIG. 1A.
Figure 1F:
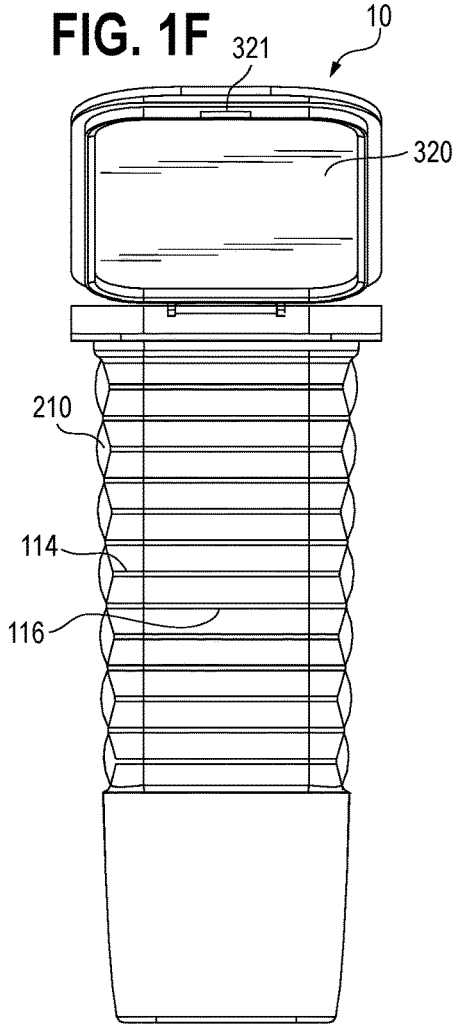
FIG. 1F is a front view of the container of FIG. 1A.
Figure 1G:
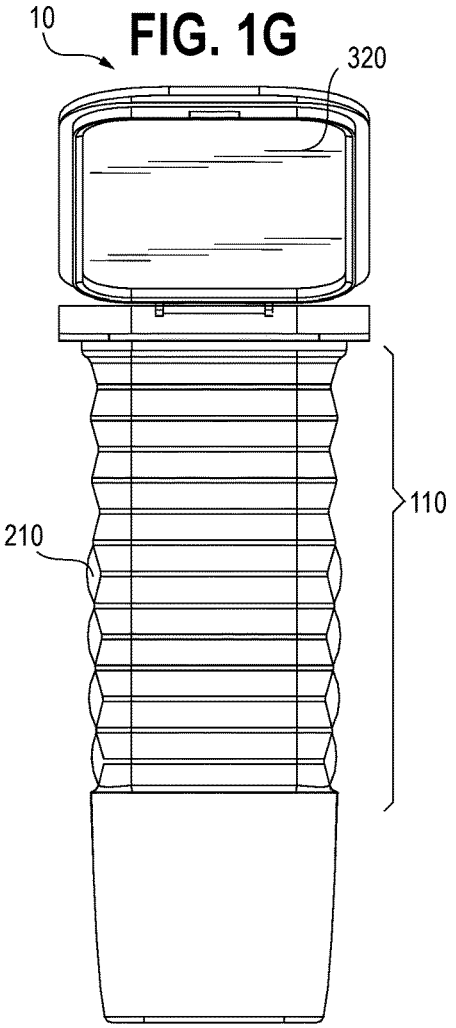
FIG. 1G is a front view of the container of FIG. 1A when some of the disclosed bump structures are indented.
Figure 1H:
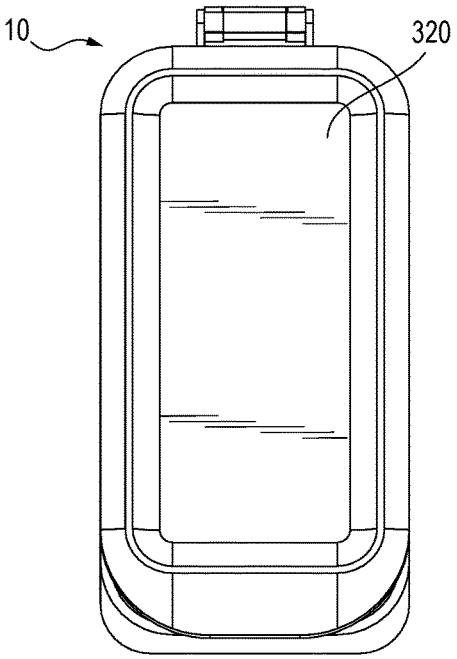
FIG. 1H is a top view of the container of FIG. 1A.
Figure 1I:
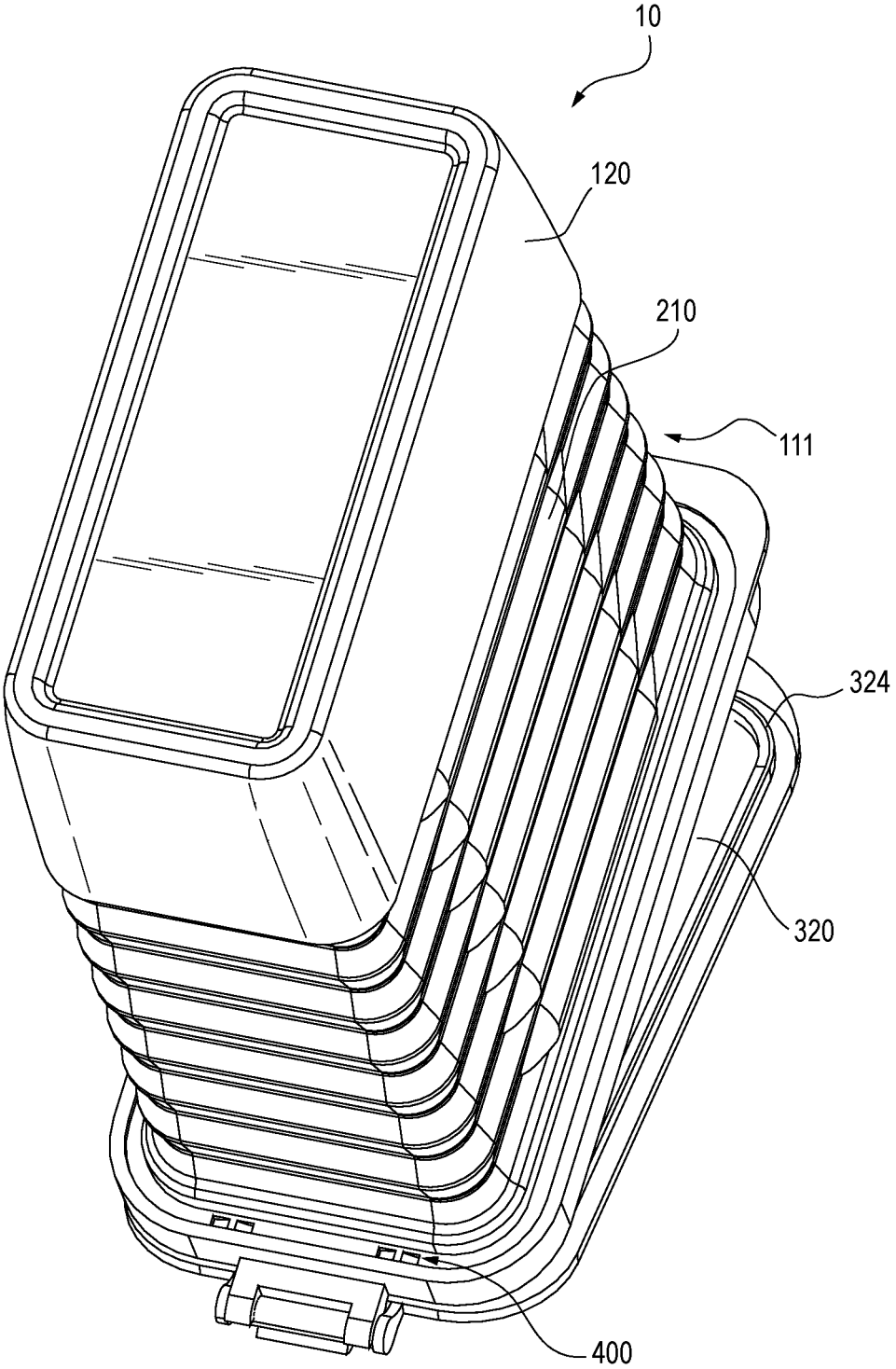
FIG. 1I is a bottom view of the container of FIG. 1A.

As shown in FIG. 1A and FIG. 1E, the container 10 further comprise a lid base 310 connected to the compressible portion 110. The lid base 310 is configured to receive a lid 320. In one implementation, the lid base 310 is a frame to be affixed on the top of the container 10. The lid base 310 may have a higher rigidity than the compressible portion 110 and the container base 120. The lid base includes a hinge 312, and the lid 320 is pivotally connected to the hinge 312. The lid 320 is detachable from the lid base 310. The hinge 312 defines an opening 315 to receive a pivot 322 of the lid 320, and the opening 315 faces away from the lid base 310. Exemplarily, the lid 320 can rotate for approximately 270 degrees, and the lid 320 can be made of polypropylene. The lid base 310 further includes a protrusion 319 (as shown in FIG. 1E), and the protrusion 319 is used to engage with the lid 320 to secure the lid 320 in a closed status. The lid 320 may have a corresponding protrusion or a concave 321 (as shown in FIG. 1F) that fits with the protrusion 319 to engage with the protrusion 319.

Figure 2A:
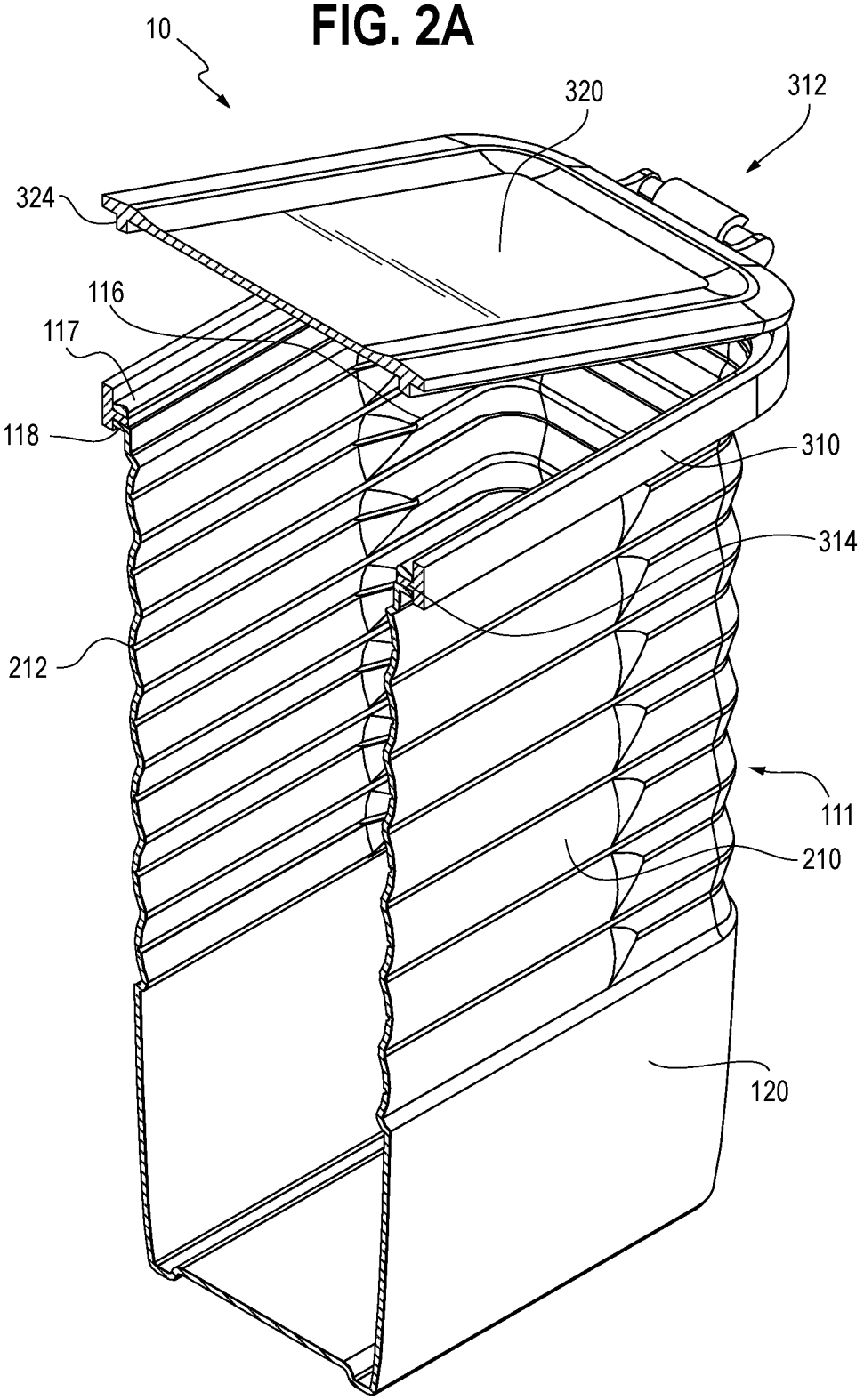
FIG. 2A is a cross-sectional perspective view of the container of FIG. 1A.
Figure 2B:
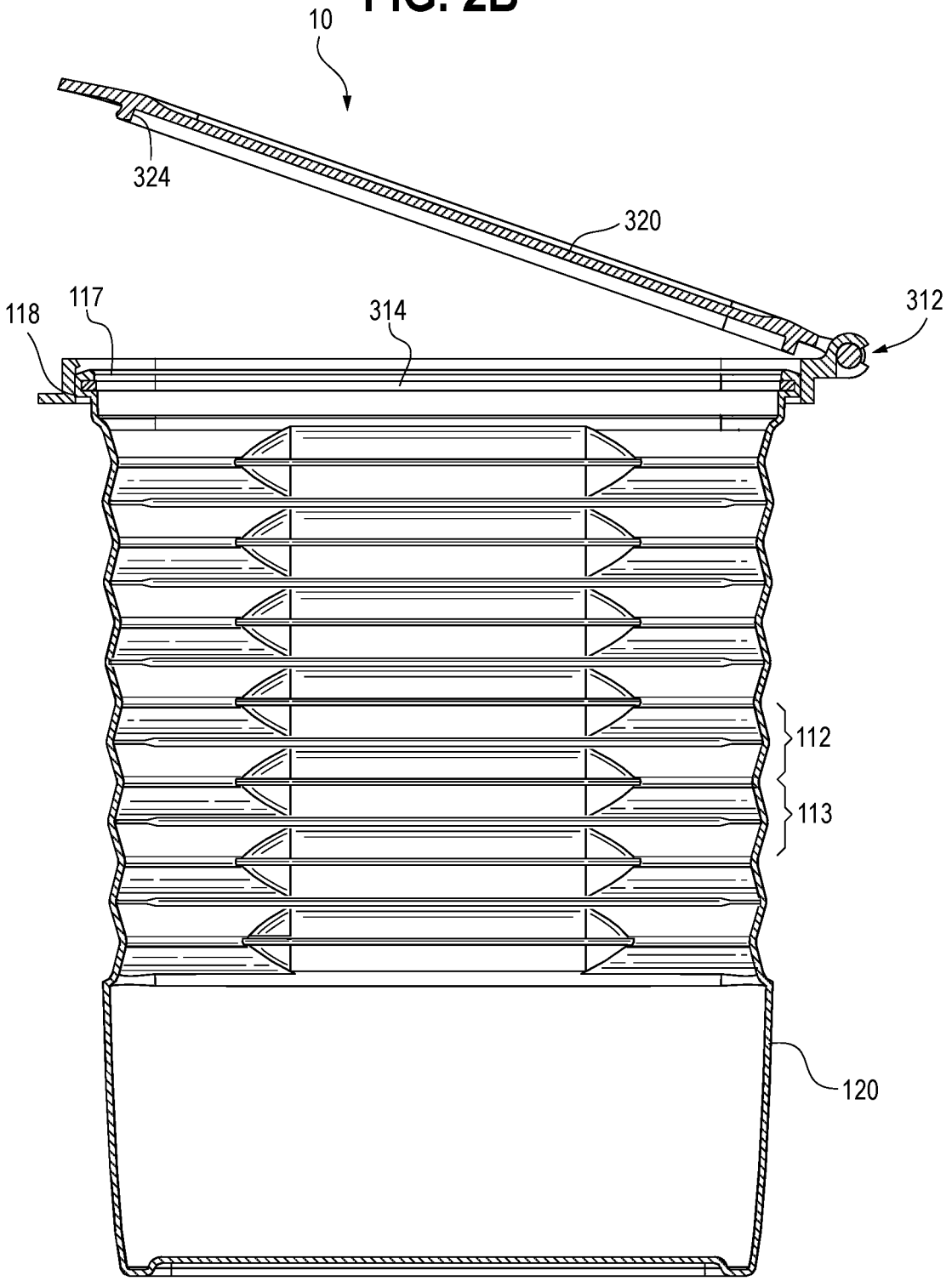
FIG. 2B is a cross-sectional perspective view of the container of FIG. 1A along a cross-sectional line perpendicular to the cross-sectional line of FIG. 2A.
Figure 2C:
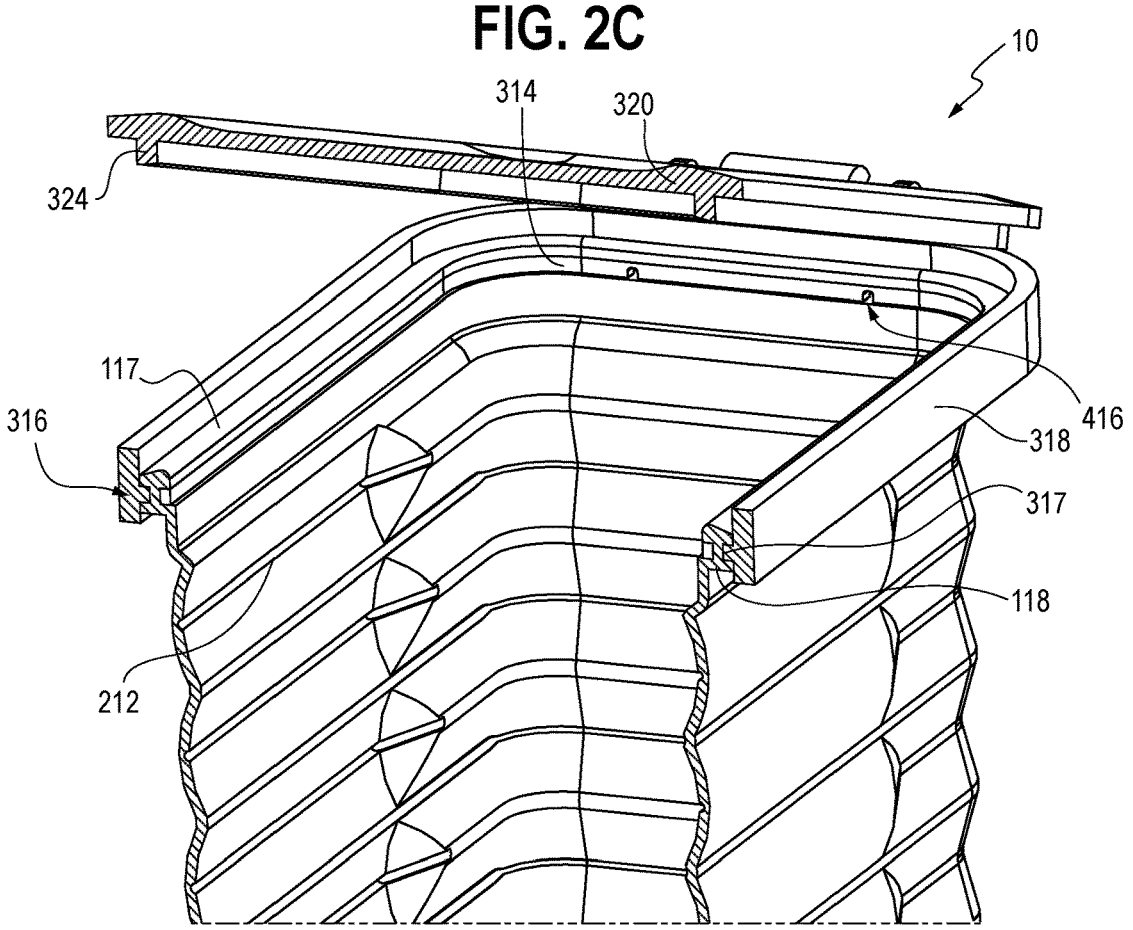
FIG. 2C is another cross-sectional perspective view of the container of FIG. 1A from a different location from FIG. 2A.
Figure 2D:
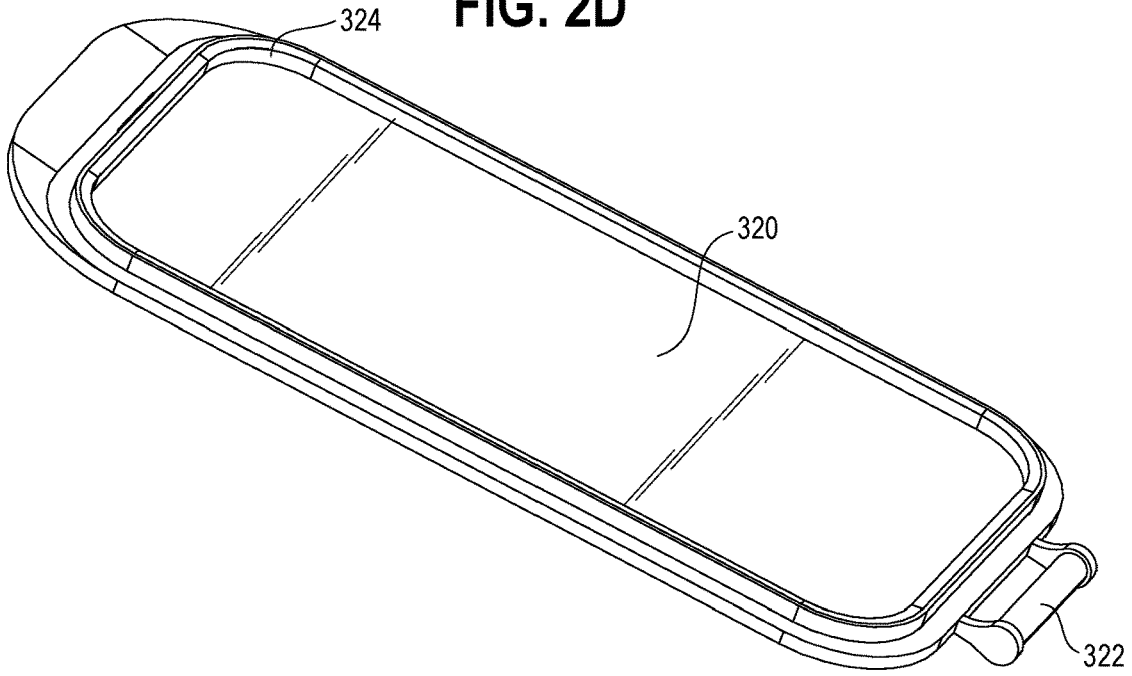
FIG. 2D shows the lid of the container of FIG. 1A when the lid is upside down.

Additionally, as shown in FIGS. 2A, 2B, and 2C, the lid base 310 includes a first skirt 314. The compressible portion 110 includes a gasket 117 and a second skirt 118. The gasket 117, the first skirt 314, and the second skirt 118 stack with each other sequentially. The gasket 117 touches the protrusion 324 on the bottom surface of the lid 320 when the lid 320 is closed. The gasket 117 and the lid 320, specifically the protrusion 324, seal the main opening of the container 10. Exemplarily, the gasket 117 and the protrusion 324 (as shown in FIG. 2D) on the lid are contoured to each other. Further, the gasket 117 is contoured with the lid base 310. The gasket 117 and the protrusion 324 may each form a closed loop.

Additionally as shown in FIG. 2C, the first skirt 314 forms one or more through holes 316 on the lid base 310, and the gasket 117 and the second skirt 118 are connected to each other by one or more connecting parts 317 in the through holes 316. The through holes 316 may be distributed around the periphery of the lid base 310. The connecting parts 317 are formed by a molding process, such that the gasket 117 and the second skirt 118 are formed together with the same material, such as silicone. The lid base 310 is thereby affixed with the gasket 117 and the second skirt 118 with the connection of the first skirt 314 with the gasket 117 and the second skirt 118. The lid base 310 is thereby affixed with the compressible portion 110.

For manufacturing, the container 10 can, for example, be made by an insert molding process. Specifically, the lid base 310 can be prepared first by a molding process, such as an injection molding. The lid base 310 can be made of polypropylene. Then, the body of the container 10, such as the container base 120 and the compressible portion 110, can be affixed together with the lid base 310 by insert molding. The container base 120 and the compressible portion 110 therefore can be formed in the same molding process. The lid base 310 has a wall 318, and the wall 318 surrounds the first skirt 314, the gasket 117, and the second skirt 118. That is, the geometry of the lid base 310 is larger than the compressible portion 110 and the container base 120.

In one embodiment as shown in FIGS. 3A to 3F, the container 10 includes at least one valve or vent 400, such as a one-way valve or vent. When the container 10 is compressed, the valve 400 can discharge the air in the container 10 in reaction to the force is exerted on the container 10.

Otherwise, the valve 400 remains closed when there is no sufficient air pressure from the container interior 11 to open the value, such that the air outside the container 10 does not easily enter the container 10. As an example, the food stored therein can thereby be preserved better.

Exemplarily, the valve or vent 400 can be configured as part of the compressible portion 110. For example, the valve 400 can be situated underneath the second skirt 118 of the compressible portion 110. The valve 400 can be situated next to the inner surface of the wall 318 of the lid base 310. The valve 400 may include a rib 424 and a pair of leaflets 420. The pair of leaflets 420 extend from the rib oppositely, and a thickness of each of the leaflets 420 gradually reduces along with the leaflet 420 in a direction extending away from the rib 424. Specifically, the end of the leaflet 420 attached to the rib 424 has the largest thickness, and the end of the leaflet 420 opposite to the rib 424 has the smallest thickness. The leaflet 420 can be in a shape of a triangular prism or a trapezoidal prism. This design facilitates the leaflet 420 to deform to allow the air to pass the valve 400 and discharge. The valve 400 and the leaflet 420 can be made of silicone to provide proper flexibility. The valve 400 and the leaflet 420 can be formed during the same molding process as the compressible portion 110.

Figure 3A:
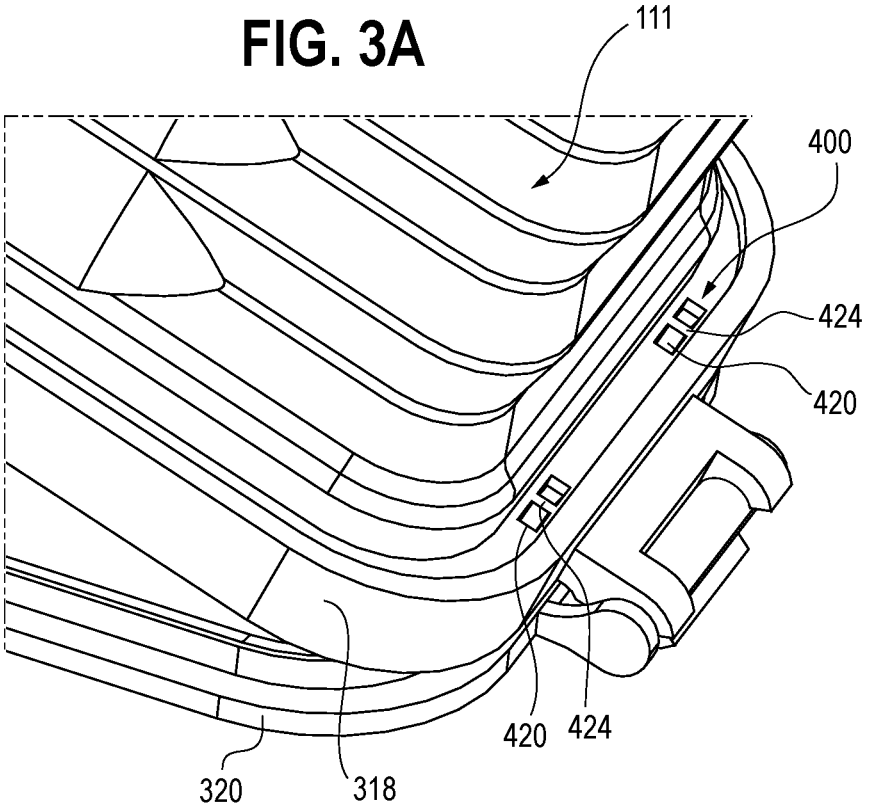
FIG. 3A is an enlarged perspective view of the container of FIG. 1A when the container is upside down.
Figure 3B:
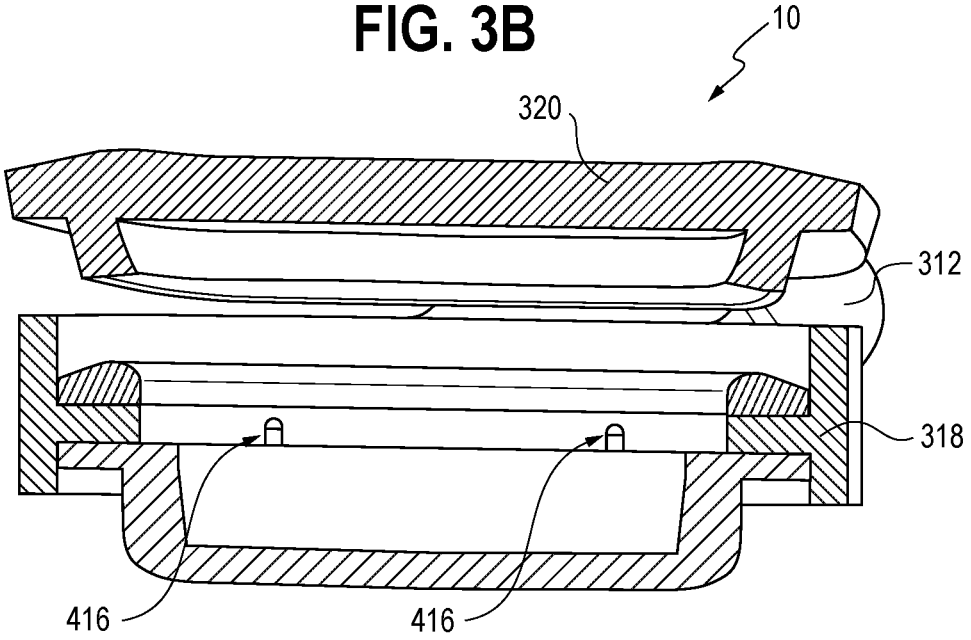
FIG. 3B is a cross-sectional view of the container of FIG. 1A.
Figure 3C:
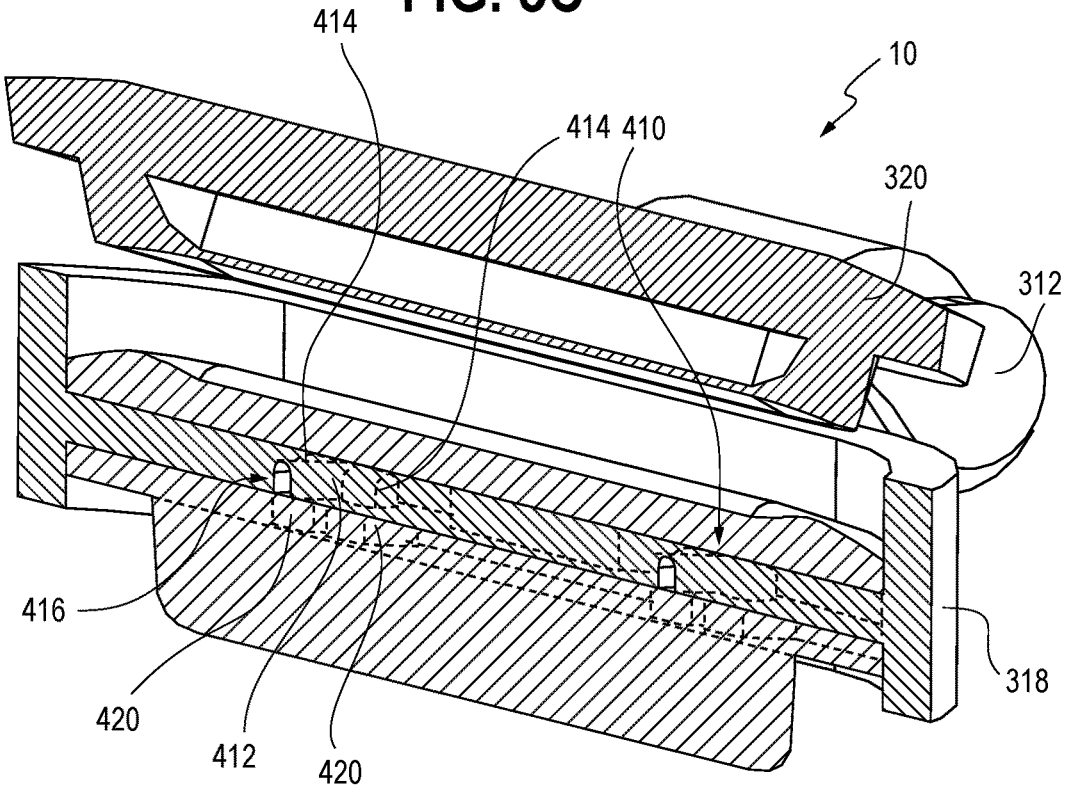
FIG. 3C is an illustrative cross-sectional view of the container of FIG. 1A.
Figure 3D:
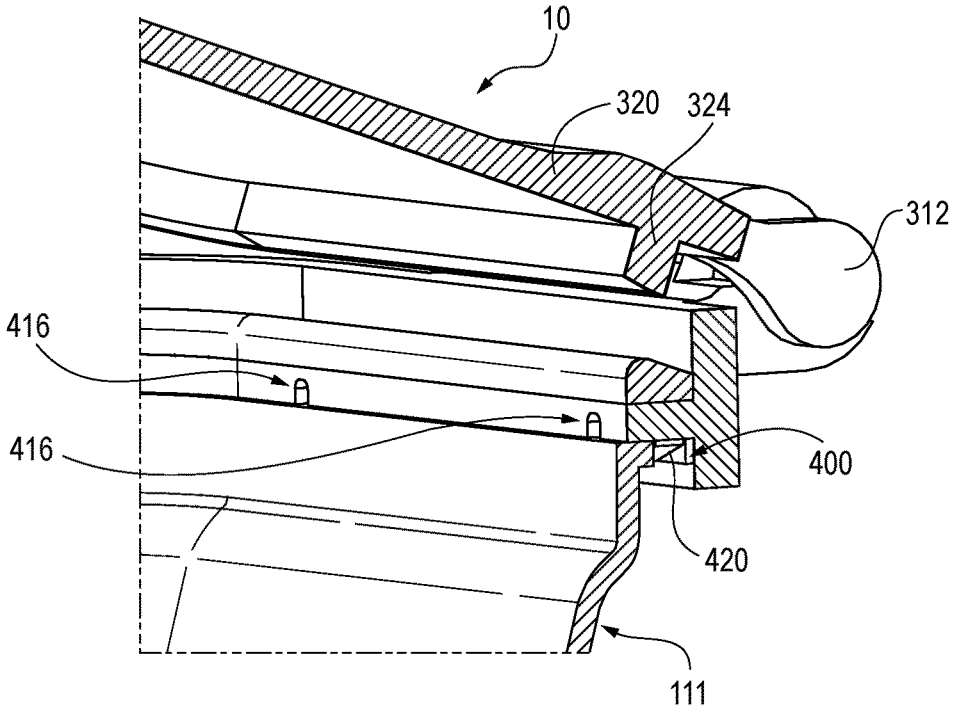
FIG. 3D is another illustrative cross-sectional view of the container of FIG. 1A.
Figure 3E:
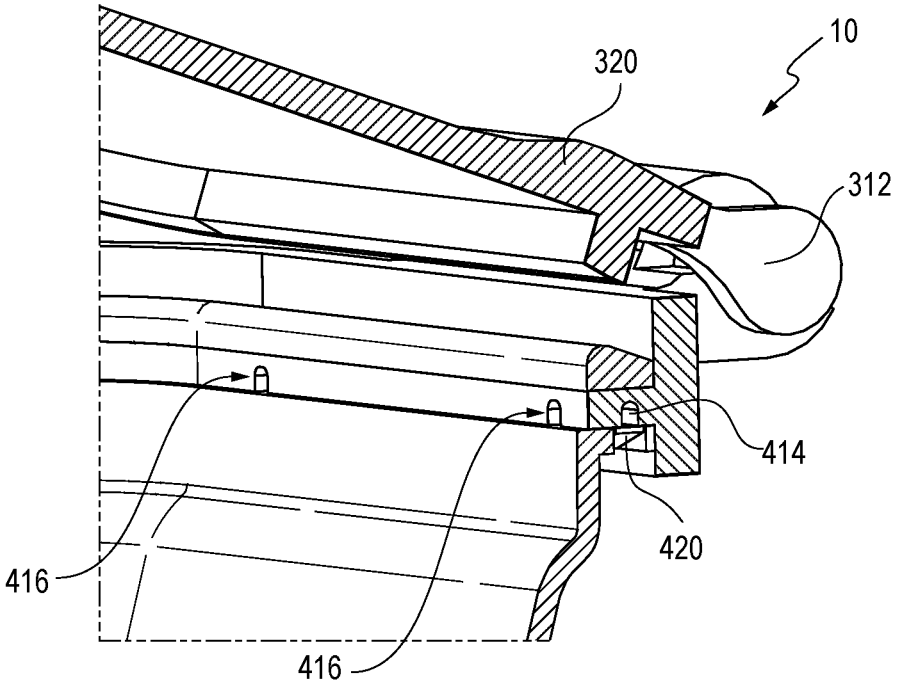
FIG. 3E is still another illustrative cross-sectional view of the container of FIG. 1A.
Figure 3F:
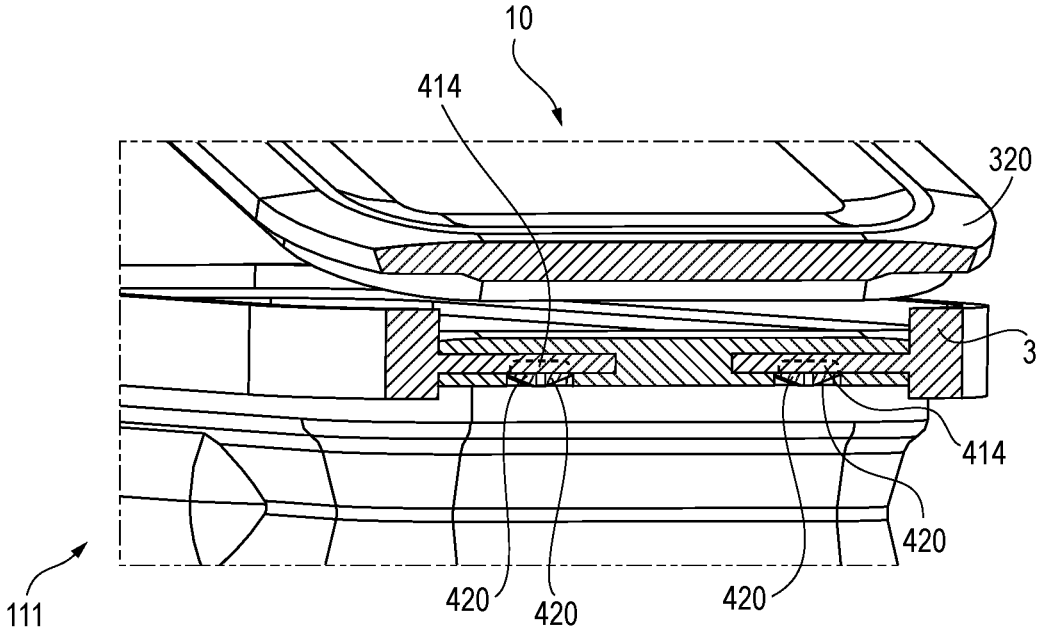
FIG. 3F is a rear cross-sectional view of the container of FIG. 1A.
Figure 3G:
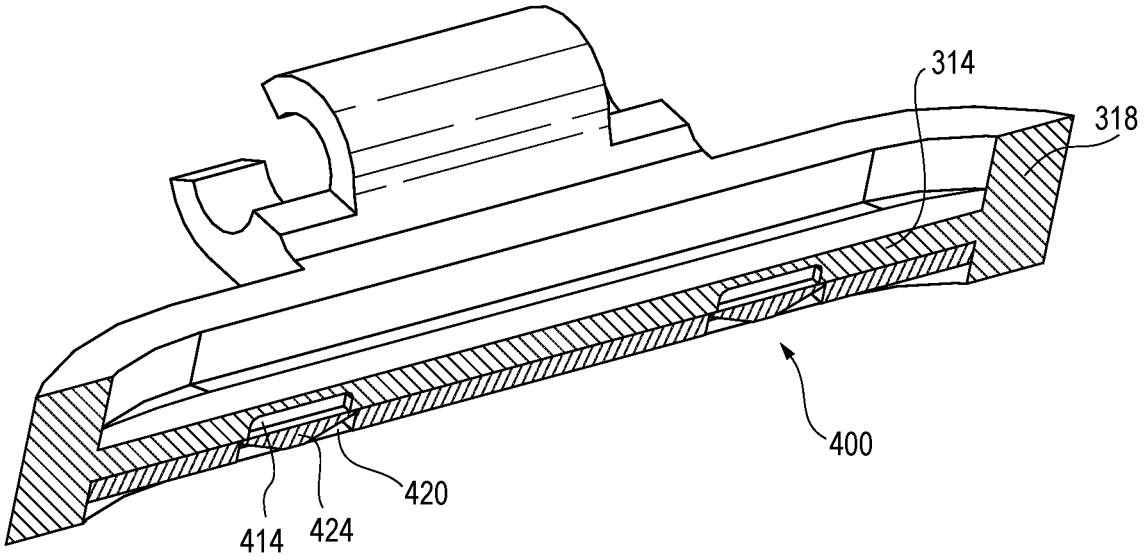
FIG. 3G is another illustrative cross-sectional view of the container of FIG. 1A.
Figure 3H:
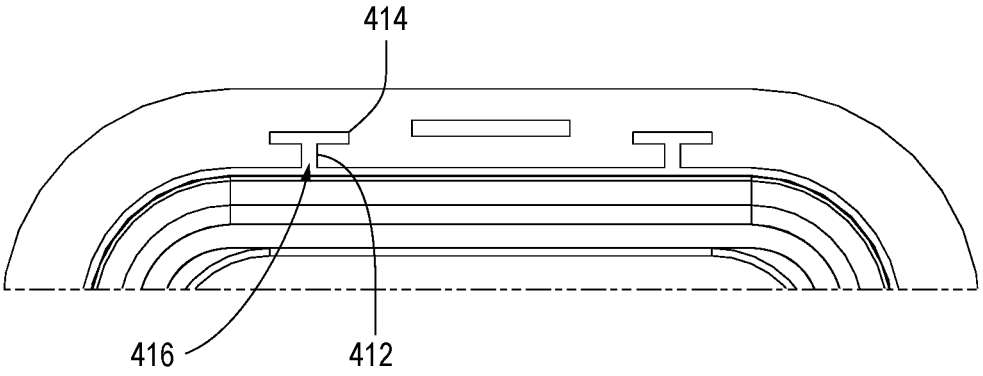
FIG. 3H is a illustrative partial top view of the container of FIG. 1A when the lid is removed.

Further, the lid base 310 may define at least one channel 410 (as shown in FIG. 3C). The channel includes a first branch 412 and a second branch 414, where the first branch 412 and the second branch 414 are substantially perpendicular to each other. The first branch 412 defines an opening 416 of the channel 410 to the container interior 11, and the second branch 414 stacks with the pair of leaflets 420 of the valve 400. Exemplarily, the container 10 has two channels 410, which form two openings 416. The channels 410 can be in a T shape. When the air in the container interior 11 flows into the opening 416, the air flows along the first branch 412. Then the air is diverted into two paths when the air reaches the end of the first branch 412. The air then enters the second branch 414. The second branch 414 overlaps with the leaflets 420, such that when the pressure in the container exceeds a certain threshold, the air in the container 10 will push the leaflets 420 to deform and will be discharged as the valve 400 is opened. Otherwise, the leaflets 420 remain their original position when there is no sufficient air pressure from the container interior 11 to deform the leaflets 420, such that the air outside the container 10 does not easily enter the container 10. As an example, the food stored therein can thereby be preserved better.

In one embodiment, the first branch 412 aligns with the rib 424, and the second branch 414 aligns with the leaflet 420. Further, the leaflet 420 may extend outwards over the end of the second branch 414 to ensure that the second branch 414 is fully covered by the leaflet 420. That is, the length of the second branch 414 is smaller than the total length of the two leaflets 420 and the rib 424 along the longitudinal axis of the second branch 414.

In one embodiment, a ratio (H1/H2) of a height of the compressible portion 110 (H1) to a height of the container base 120 (H2), when the compressible portion 110 is fully expanded, is less than 2.0. In another embodiment, the ratio is less than 1.9. In still another embodiment, the ratio is less than 1.5 or 1.0. Further, in one embodiment, a ratio of the height of the container 10, when the compressible portion 110 is full compressed, to the height of the container 10, when the compressible portion 110 is fully expanded, is more than 40%, 45%, 50%, 55%, or 60%.

One embodiment of this disclosure provides a container, which comprises a lid base 310 and a compressible portion 110. The lid base 310 has a channel and is configured to receive a lid 320. The compressible portion 110 is connected to the lid base 310, and the compressible portion 110 includes a one-way valve in air communication with the channel. The components of this container of this embodiment can be selectively adopted in the implementation disclosed above.

One embodiment of this disclosure provides a container. The container comprises a lid base and a body. The lid base is configured to receive a lid and includes a first skirt 314. The body includes a gasket 117 and a second skirt 118. The gasket 117, the first skirt 314, and the second skirt 118 stack with each other sequentially. The body may include a compressible portion 110 and a container base 120. The components of this container of this embodiment can be selectively adopted in the implementation disclosed above.

Figure 5A:
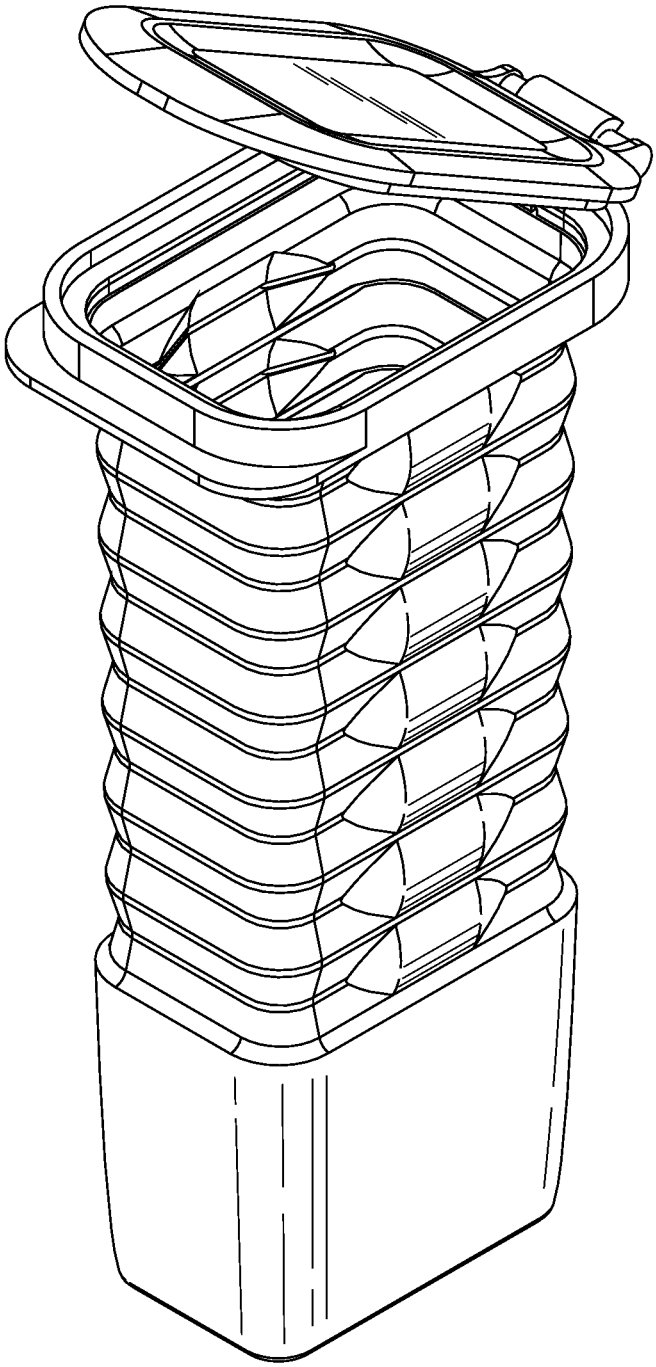
FIGS. 5A and 5B show containers having different dimension from the container of FIG. 1A.
Figure 5B:
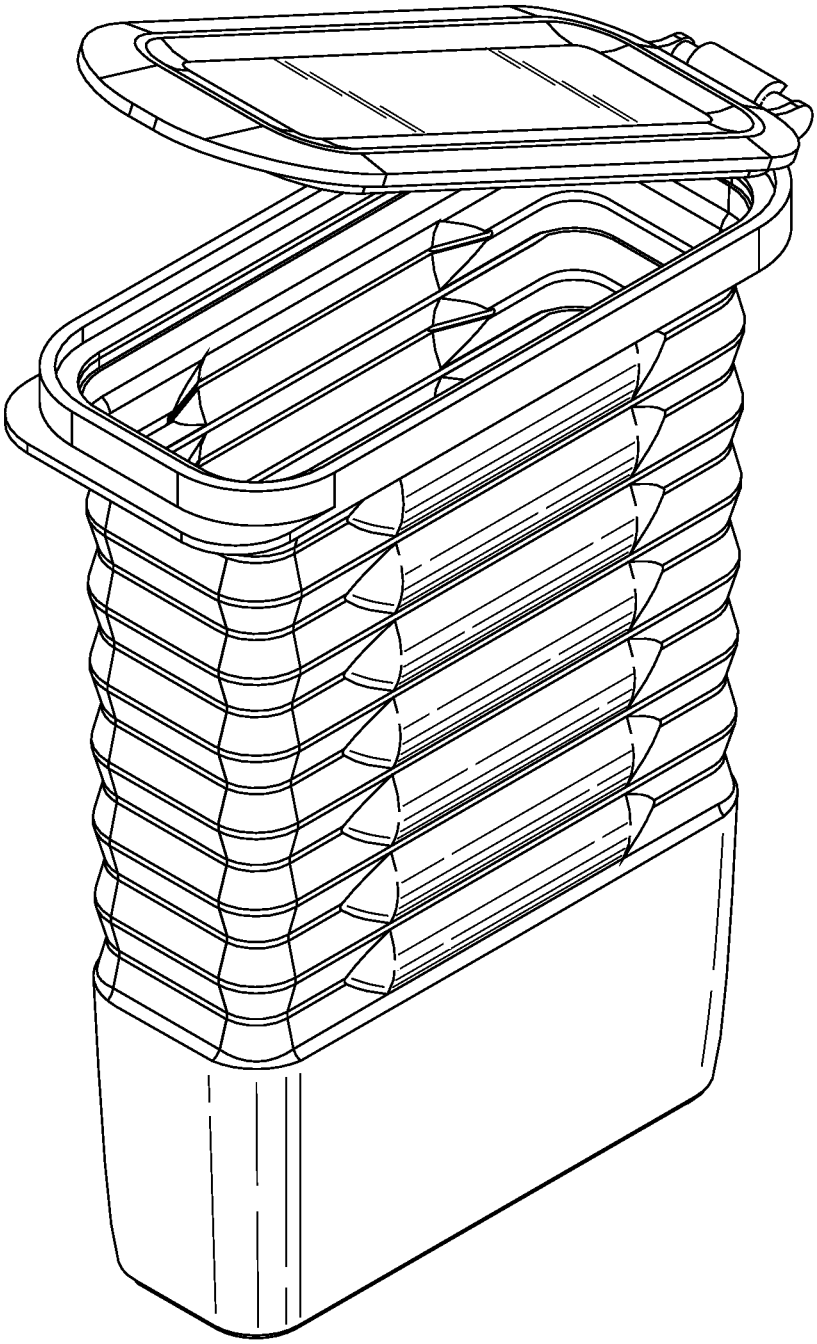

As shown in FIG. 5A and FIG. 5B, the above implementation can be implemented in containers of different sizes. The container may have a different length, width, and/or height as to the container 10. Likewise, the shape of the containers of this disclosure can be, for example, square, rectangular, circular, or any other shape, without departing from the scope of the present disclosure.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

One skilled in the art will realize that a virtually unlimited number of variations to the above descriptions are possible, and that the examples and the accompanying figures are merely to illustrate one or more examples of implementations.

It will be understood by those skilled in the art that various other modifications can be made, and equivalents can be substituted, without departing from claimed subject matter. Additionally, many modifications can be made to adapt a particular situation to the teachings of claimed subject matter without departing from the central concept described herein. Therefore, it is intended that claimed subject matter not be limited to the particular embodiments disclosed, but that such claimed subject matter can also include all embodiments falling within the scope of the appended claims, and equivalents thereof.

In the detailed description above, numerous specific details are set forth to provide a thorough understanding of claimed subject matter. However, it will be understood by those skilled in the art that claimed subject matter can be practiced without these specific details. In other instances, methods, devices, or systems that would be known by one of ordinary skill have not been described in detail so as not to obscure claimed subject matter.

Reference throughout this specification to "one embodiment," "an embodiment," "one aspect," or "an aspect" can mean that a particular feature, structure, or characteristic described in connection with a particular embodiment can be included in at least one embodiment of claimed subject matter. Thus, appearances of the phrase "in one embodiment," "an embodiment," "in on aspect," or "an aspect," in various places throughout this specification are not necessarily intended to refer to the same embodiment or to any one particular embodiment described. Furthermore, it is to be understood that particular features, structures, or characteristics described can be combined in various ways in one or more embodiments. In general, of course, these and other issues can vary with the particular context of usage. Therefore, the particular context of the description or the usage of these terms can provide helpful guidance regarding inferences to be drawn for that context.

What is claimed is:

1. A container, comprising:

a compressible portion, including:

a bellow body, including:

at least two convolutions, each including a first living hinge and a first sidewall;

at least one second living hinge positioned between the at least two convolutions and connected to the first sidewalls; and a movable bump structure positioned between the at least two convolutions to space the first living hinges apart and being movable between an outer position and an inner position relative to a container interior, a rigidity of the bump structure being higher than a rigidity of the first sidewalls of the at least two convolutions when the bump structure is situated at the outer position relative to the container interior; and a container base, connected to the compressible portion.

2. The container of claim 1, wherein the movable bump structure includes a third living hinge on an inner side of the bump structure and the third living hinge allows a second sidewall of the movable bump structure to pivot on the third living hinge, the third living hinge aligning with the at least one second living hinge of the bellow body.

3. The container of claim 1, further comprising a lid base connected to the compressible portion, wherein the lid base is configured to receive a lid.

4. The container of claim 3, wherein:

the lid base includes a first skirt;

the compressible portion includes a gasket and a second skirt; and the gasket, the first skirt, and the second skirt stack with each other sequentially, wherein the first skirt forms one or more through holes and the gasket and the second skirt are connected to each other by one or more connecting parts in the through holes.

5. The container of claim 3, wherein:

the lid base includes a first skirt;

the compressible portion includes a gasket positioned on the first skirt; and the lid and the gasket seal an opening defined by the first skirt.

6. The container of claim 3, wherein a first skirt of the compressible portion includes a valve and the lid base includes a channel in air communication with the valve.

7. The container of claim 6, wherein:

the valve includes a rib and a pair of leaflets extending from the rib oppositely, and a thickness of each of the leaflets gradually reduces in a direction extending away from the rib; and the channel includes a first branch and a second branch, the first branch and the second branch are substantially perpendicular to each other, the first branch defines an opening of the channel to the container interior, and the second branch stacks with the pair of leaflets of the valve.

8. The container of claim 1, wherein a ratio of a height of the compressible portion to a height of the container base, when the compressible portion is fully expanded, is less than 1.9.

9. The container of claim 1, wherein the movable bump structure includes a first sidewall extending from the first living hinge of the at least two convolutions to the other first living hinge of the at least two convolutions.

10. The container of claim 9, wherein the second sidewall of the bump structure is thicker than the first sidewalls of the at least two convolutions.

11. The container of claim 9, wherein the second sidewall of the bump structure is thinner than the first sidewalls of the at least two convolutions.

12. The container of claim 9, wherein:

the movable bump structure includes two end walls at two opposite ends of the second sidewall of the bump structure, the two end walls being connected to the first sidewalls of the at least two convolutions and the second living hinge; and each of the two end walls defines three tips, the three tips respectively connected to the first living hinges and the second living hinge.

13. A container, comprising:

a lid base having a channel and configured to receive a lid; and a compressible portion connected to the lid base, wherein the compressible portion includes a first skirt, the first skirt including a one-way valve in air communication with the channel.

14. The container of claim 13, wherein the valve includes a rib and a pair of leaflets extending from the rib, a thickness of each of the leaflet gradually reducing along with the leaflet extending away from the rib.

15. The container of claim 14, wherein the channel includes a first branch and a second branch, first branch and the second branch are substantially perpendicular to each other, the first branch defines an opening of the channel to inside of the container, and the second branch stacks with the pair of leaflets of the valves.

16. The container of claim 13, further comprising a container base connected to the compressible portion, wherein the container base is made of polypropylene or silicone and the compressible portion is made of silicone.

17. A container, comprising:

a lid base configured to receive a lid and including a first skirt, the lid base having a channel; and a body including a gasket and a second skirt, wherein the gasket, the first skirt, and the second skirt stack with each other sequentially, wherein the second skirt includes a one-way valve in air communication with the channel.

18. The container of claim 17, wherein the first skirt forms one or more through holes and the gasket and the second skirt are connected to each other by one or more connecting parts in the through holes.

19. The container of claim 18, wherein the gasket, the second skirt, and the one or more connecting parts are made from the same material, which is different from a material of the lid base.

* * * * *